US007661789B2

(12) United States Patent
Shimizu

(10) Patent No.: US 7,661,789 B2
(45) Date of Patent: Feb. 16, 2010

(54) IMAGE RECORDING APPARATUS

(75) Inventor: Masanobu Shimizu, Hachioji (JP)

(73) Assignee: Olympus Corporation, Tokyo (JP)

( * ) Notice: Subject to any disclaimer, the term of this patent is extended or adjusted under 35 U.S.C. 154(b) by 511 days.

(21) Appl. No.: 10/999,709

(22) Filed: Nov. 30, 2004

(65) Prior Publication Data

US 2005/0122372 A1 Jun. 9, 2005

(30) Foreign Application Priority Data

Dec. 4, 2003 (JP) ..... 2003-405788

(51) Int. Cl.

| | |
|---|---|
| ***B41J 2/165*** | (2006.01) |
| ***B41J 3/00*** | (2006.01) |
| ***B41J 2/01*** | (2006.01) |
| ***B41J 29/13*** | (2006.01) |

(52) U.S. Cl. ..... 347/22; 347/4; 347/101; 347/108

(58) Field of Classification Search ..... 347/22, 347/108, 101, 4

See application file for complete search history.

(56) References Cited

U.S. PATENT DOCUMENTS

| | | | | |
|---|---|---|---|---|
| 4,469,430 | A * | 9/1984 | Terashima | 347/134 |
| 5,936,654 | A * | 8/1999 | Yokoyama et al. | 347/217 |
| 6,030,069 | A * | 2/2000 | Wakahara et al. | 347/55 |
| 6,170,939 | B1 * | 1/2001 | Ujita et al. | 347/86 |
| 6,325,479 | B1 * | 12/2001 | Nakamura et al. | 347/19 |
| 6,356,293 | B1 * | 3/2002 | Chiba | 347/262 |
| 6,459,858 | B1 * | 10/2002 | Davis | 399/2 |
| 6,523,948 | B2 * | 2/2003 | Matsumoto et al. | 347/102 |
| RE38,092 | E * | 4/2003 | Yamada et al. | 347/101 |
| 2001/0026705 | A1 * | 10/2001 | Sato et al. | 399/98 |
| 2002/0110382 | A1 * | 8/2002 | Okawa et al. | 399/81 |

(Continued)

FOREIGN PATENT DOCUMENTS

JP 61-224498 A 10/1986

(Continued)

OTHER PUBLICATIONS

Japanese Office Action dated Aug. 25, 2009 and English translation thereof issued in a counterpart Japanese Application No. 2003-405788.

(Continued)

*Primary Examiner*—Stephen D Meier
*Assistant Examiner*—Sarah Al-Hashimi
(74) *Attorney, Agent, or Firm*—Frishauf, Holtz, Goodman & Chick, P.C.

(57) ABSTRACT

The present invention is an image recording apparatus comprising an image recording unit which records an image by ejecting ink drops with respect to an recording medium, a conveyance unit conveys the recording medium at the time of image recording by the conveying driving means, a recording medium feeding unit which feeds the recording medium to the conveyance unit, and a particulate dust preventing unit which has a partitioning member partitioning space in the image recording apparatus into an image recording region GR at which image recording is carried out by the image recording unit, and a paper feeding region FR at which the recording medium is fed by the recording medium feeding unit, and which can carry out image recording in high image quality and with high reliability, without deteriorating the conveying ability for a recording medium.

4 Claims, 9 Drawing Sheets

U.S. PATENT DOCUMENTS

| | | | | |
|---|---|---|---|---|
| 2003/0049043 | A1* | 3/2003 | Fuwazaki et al. | 399/98 |
| 2003/0076399 | A1* | 4/2003 | Matsuo et al. | 347/104 |
| 2003/0107609 | A1* | 6/2003 | Shiraishi | 347/6 |
| 2004/0017467 | A1* | 1/2004 | Torisawa | 347/223 |
| 2004/0027409 | A1* | 2/2004 | Miyauchi | 347/30 |
| 2004/0141041 | A1* | 7/2004 | Tsutsumi et al. | 347/102 |
| 2004/0246293 | A1* | 12/2004 | Sanpei et al. | 347/22 |

FOREIGN PATENT DOCUMENTS

| | | | |
|---|---|---|---|
| JP | 7-112539 | A | 5/1995 |
| JP | 7112539 | A * | 5/1995 |
| JP | 08-324057 | A | 12/1996 |
| JP | 2000-85114 | A | 3/2000 |
| JP | 2001-71480 | A | 3/2001 |
| JP | 2002-192711 | A | 7/2002 |
| JP | 2003-212379 | A | 7/2003 |
| JP | 2003-220695 | A | 8/2003 |

OTHER PUBLICATIONS

Japanese Office Action dated Nov. 17, 2009 and English translation thereof issued in a counterpart Japanese Application No. 2003-405788.

* cited by examiner

IMAGE RECORDING APPARATUS

CROSS-REFERENCE TO RELATED APPLICATIONS

This application is based upon and claims the benefit of priority from the prior Japanese Patent Application No. 2003-405788, filed Dec. 4, 2003, the entire contents of which are incorporated herein by reference.

BACKGROUND OF THE INVENTION

1. Field of the Invention

The present invention relates to an image recording apparatus which records an image upon a recording medium.

2. Description of the Related Art

Generally, an image recording apparatus such as an ink jet printer has a paper feeding unit for feeding a recording medium, a conveyance unit for conveying the recording medium from the paper feeding unit, and an image recording unit for recording an image conveyed by the conveyance unit.

The paper feeding unit houses recording media such as papers for use in image recording, OHP papers, or the like. Further, the paper feeding unit has conveying driving means such as a pickup roller in order to pick up the housed recording media and transmit a recording medium to the conveyance unit. The conveying driving means comes in contact with a recording medium, applies self driving force to the recording medium, and conveys the recording medium in a predetermined direction. The image recording unit records an image by ejecting ink with respect to the recording medium in the course of conveyance by the conveyance unit.

In this way, the conveying driving means of the paper feeding unit and the conveyance unit come in contact with a recording medium at the time of conveying the recording medium. Therefore, the recording medium generates particulate dust such as paper particles due to friction with the conveying driving means, an impact at the time of contacting, or the like. The generated particulate dust floats in the atmosphere, and drift about inside the image recording apparatus. Note that the recording medium is generally cut into a predetermined size. This cutting unit easily generates particulate dust such as paper particles. Accordingly, it is difficult to prevent particulate dust from being generated due to the friction or impact from cut regions.

Further, the recording medium is housed and stored in the paper feeding unit. Particulate dust such as dust in the atmosphere or the like is adhered to the recording media in storage. The adhered particulate dust drifts about inside the image recording apparatus by the friction or impact.

When the particulate dust made to float in this way move to the periphery of the image recording unit, there is the possibility that the particulate dust may be adhered to the image recording unit, which may have a harmful influence on a characteristic of jetting ink of the image recording unit. For example, in the case of an ink jet system image recording apparatus, the image recording unit has a nozzle which jets out ink.

In this ink jet system image recording apparatus, when the aforementioned particulate dust moves to the periphery of the image recording unit, there is the possibility that the moved particulate dust may adhere to the nozzle, or may intrude into the nozzle. When the particulate dust adheres to or intrude into the nozzle, there is the possibility that ink cannot be ejected from the nozzle, or a change in the orbit of the ejected ink (ejection curve) may be brought about.

Then, an image recording apparatus having a configuration in which particulate dust intruding into the image recording apparatus are reduced has been considered.

A conventional image recording apparatus having such a configuration is shown, for example in Jpn. Pat. Appln. KOKAI Publication No. 2003-220695 (Patent Document 1). FIG. 17 is a diagram showing the image recording apparatus in the publication.

The image recording apparatus has a recording head housing 102 in which a plurality of recording heads 104 are disposed, and a conveyance mechanism housing 101 in which a recording medium conveyance mechanism unit 105 at which a paper feeding unit is disposed is disposed. A recording medium 103 is a serial roll paper. The recording medium conveyance mechanism unit 105 is composed of conveyance rollers 106*a* and 107*a*, pressing rollers 106*b* and 107*b*, and rollers 108 and 109.

The recording head housing 102 and the conveyance mechanism housing 101 are connected through openings 112*a* and 112*b*, and are configured such that air can be circulated via these openings 112*a* and 112*b* each other. The recording heads 104 are an image recording unit which records an image by ejecting ink with respect to the recording medium 103.

Fans 114 and 115 are provided in the recording head housing 102, and air is made to flow into the recording head housing 102 from the exterior by the fans 114 and 115. The air is guided by a wind direction guide 141, and is made to flow into the conveyance mechanism housing 101 via the openings 112*a* and 112*b*. According to the above-described configuration, the image recording apparatus of Patent Document 1 brings about an airflow flowing from the side of the recording heads 104 to the side of the paper feeding unit (in the up and down direction in FIG. 17) in order to prevent paper particles or particulate dust from adhering to the ink jet heads.

In the image recording apparatus disclosed in Jpn. Pat. Appln. KOKAI Publication No. 2003-220695 described above, the recording head housing 102 and the conveyance mechanism housing 101 including a paper feeding region at which paper feeding is carried out are connected so as to eject particulate dust from the recording head housing 102 including an image recording region at which image recording is carried out. In addition thereto, the wind direction guide 141 is configured in order to prevent the air which has been blown from the fans 114 and 115 from directly blowing against the recording heads 104, and an interval with the recording medium 103 has been not considered. Accordingly, an attempt that the image recording region and the paper feeding region are spatially separated is not made.

Moreover, with respect to the recording head housing 102, an attempt that the image recording region and the other regions are spatially separated is not made. Therefore, with respect to the image recording region at which the recording heads 104 are provided, a preventing measure for that paper particles intrude from the direction crossing the aforementioned airflow (the cross direction in FIG. 17) has been not considered, and there has been the possibility that particulate dust from this direction may intrude depending on the convection of air.

BRIEF SUMMARY OF THE INVENTION

An object of the present invention is to provide an image recording apparatus which can carry out image recording in high image quality and with high reliability, without deteriorating the conveying ability for a recording medium.

The image recording apparatus of the present invention is an image recording apparatus for recording an image, and is configured by an image recording unit which records an image by ejecting ink drops with respect to a recording medium, a conveyance unit which has conveying driving means for applying driving force to the recording medium, and which conveys the recording medium by the conveying driving means at the time of image recording, a paper feeding unit which feeds the recording medium to the conveyance unit, and a particulate dust preventing unit having partitioning members partitioning the space in the image recording apparatus into an image recording region at which image recording is carried out by the image recording unit and an paper feeding region to which the recording medium is fed by the paper feeding unit.

DETAILED DESCRIPTION OF THE INVENTION

Hereinafter, embodiments of the present invention will be described in detail with reference to the drawings.

First, an image recording apparatus 1 according to a first embodiment of the present invention will be described.

Figure 1:
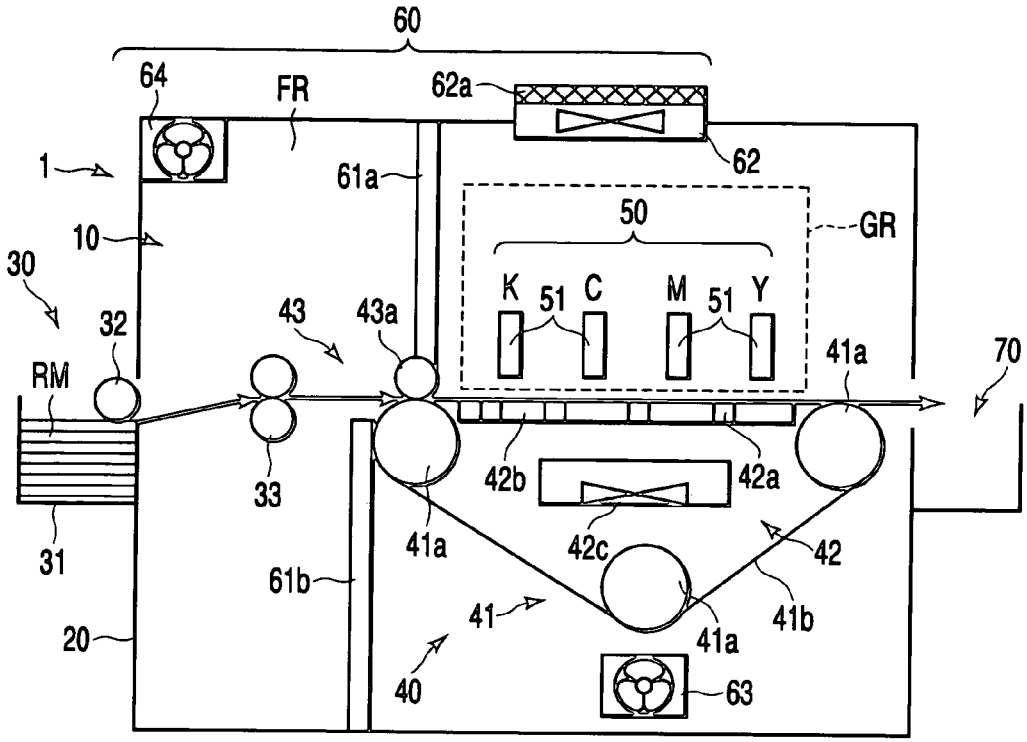
FIG. 1 is a schematic side view showing an image recording apparatus according to a first embodiment of the invention.
Figure 2:
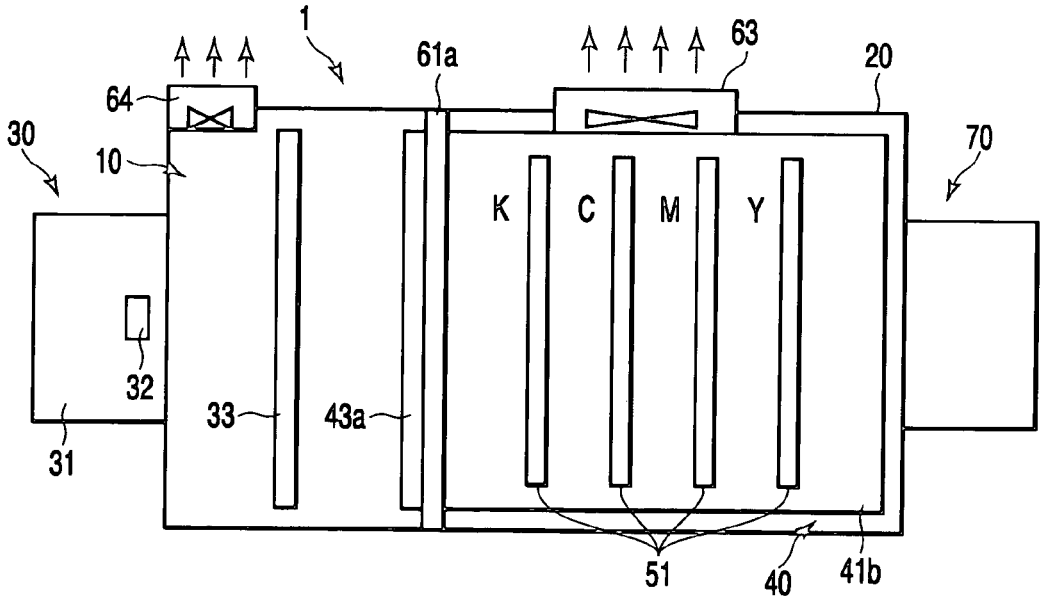
FIG. 2 is a schematic top view showing the image recording apparatus of FIG. 1.

The image recording apparatus 1 of the present embodiment has a main body 10 in which respective components are disposed, a cover unit 20 covering the main body 10, a paper feeding unit 30, a conveyance unit 40, an image recording unit 50, a particulate dust preventing unit 60, and an ejecting unit 70. First, this image recording apparatus 1 will be described with reference to FIGS. 1 to 7. FIG. 1 is a schematic side view showing the image recording apparatus 1 of the embodiment. FIG. 2 is a schematic top view showing the image recording apparatus 1 in FIG. 1.

At the main body 10, the paper feeding unit 30, the conveyance unit 40, and the image recording unit 50 are held by a frame (not shown). This main body 10 is covered with the cover unit 20. Note that, in the present embodiment, a part of the paper feeding unit 30 is disposed outside the cover unit 20. However, the entire paper feeding unit 30 can be disposed inside the cover unit 20.

The paper feeding unit 30 has a housing unit 31, a pickup roller 32, and a pair of registration rollers 33. The housing unit 31 houses a recording medium which has been cut in a predetermined length (which is shown by reference code RM in FIG. 1). The pickup roller 32 is a roller shaped rotating member, and is conveying driving means for picking up the recording medium in the housing unit 31, and for conveying it in a predetermined conveying direction. The pair of registration rollers 33 is a rotating member, and is conveying driving means for conveying the recording medium conveyed from the pickup roller 32 to the conveyance unit 40. The pair of registration rollers 33 is disposed such that the central axis in the direction of length extends in a direction (cross direction) perpendicular to the conveying direction of the recording medium. Note that the paper feeding unit 30 has a conveyance path (not shown) from the housing unit 31 up to the conveyance unit 40. The pickup roller 32 and the pair of registration rollers 33 convey the recording medium along the aforementioned conveyance path.

At the paper feeding unit 30, the pickup roller 32 and the pair of registration rollers 33 are connected so as to be touchable and detachable to an unillustrated power source via a clutch. Further, at the paper feeding unit 30, the pair of registration rollers 33 cooperates with the pickup roller 32 to adjust the direction of the recording medium in the conveying direction.

The conveyance unit 40 is conveying means for conveying the recording medium in the course of image recording. The conveyance unit 40 is disposed at a position facing the image recording unit 50. In the present embodiment, the conveyance unit 40 is configured by a belt platen unit 41 and a platen suction unit 42. The belt platen unit 41 is formed in a belt conveyer shape from a platen roller 41*a* and a platen belt 41*b* which is a non-edge belt, and conveys the recording medium from the paper feeding unit 30 along a predetermined conveying direction. Note that a conveying speed of the belt platen unit 41 is set at a speed which is slower than the conveying speed of the pair of registration rollers 33.

A plurality of holes (not shown) are provided at the platen belt 41*b*, and it is configured so as to absorb the recording medium by suction force of the platen suction unit 42. Further, a backup roller 43*a* which is a driven roller of the platen roller 41*a* is disposed at a position corresponding to the platen roller 41*a* at the upper stream of the belt platen unit 41 in the conveying direction of the recording medium. In accordance therewith, the platen roller 41*a* and the backup roller 43*a* at the upper stream are rotating members, and configure a pair of backup rollers 43.

The platen suction unit 42 has a platen 42*b* having a plurality of holes 42*a*, and a platen suction fan 42*c* for applying negative pressure to the platen 42*b*.

Note that the pair of backup rollers 43 is driven together with the pair of registration rollers 33, and adjusts the direction of the recording medium in the same way as the pair of registration rollers 33 and the pickup roller 32 described above.

In the embodiment, the image recording unit 50 has recording heads 51 corresponding to the respective colors in order to record an image with inks of four colors (black (K), cyan (C), magenta (M), yellow (Y)). Accordingly, the image recording unit 50 has the four recording heads 51. The respective recording heads 51 have a plurality of nozzles ejecting inks. These nozzles configure nozzle arrays by being arranged in a row. The respective nozzle arrays extend in a direction perpendicular to the conveying direction of the recording medium, and the lengths thereof are set so as to record an image all over the width of the recording medium. Namely, the recording heads 51 in the present embodiment are serial head (fixed head) type recording heads. As described above, in order to record an image by the image recording unit 50, in the present embodiment, the space at the periphery of the image recording unit 50 is called an image recording region. In FIG. 1, the image recording space is a region surrounded by the broken line, and is denoted by reference code GR.

The particulate dust preventing unit 60 prevents particulate dust such as paper particles, dust, or the like from intruding into the image recording region. In the embodiment, the particulate dust preventing unit 60 has partition plates 61*a* and 61*b*, a suction fan with a filter 62, and exhaust fans 63 and 64.

As shown in FIG. 1, the partition plate 61*a* is fixed to the cover unit 20, and is disposed all over the region which is upper than the backup roller 43*a*. In other words, the partition plate 61*a* extends all over the cross direction of the image recording apparatus 1, and extends all over the region which is upper than the backup roller 43*a* and the recording medium in the up and down direction (a direction perpendicular to the conveying direction and the cross direction) of the image recording apparatus 1. Note that the bottom end of the partition plate 61*a* abuts a portion at the lower stream side of the backup roller 43*a* in the conveying direction. In this way, the partition plate 61*a* is provided so as to spatially separate the region which is upper than the pair of backup rollers 43 in the conveying direction of the recording medium (the cross direction in FIG. 1). Note that a touching pressure of the partition plate 61*a* with respect to the backup roller 43*a* is preferably set to be a weight of about 10 grams as a total load in order not to deteriorate the conveying ability of the pair of backup rollers 43. However, it is not limited to the value, and can be arbitrary selected among the values by which the conveying ability is not deteriorated.

The partition plate 61*b* extends in the cross direction all over the image recording apparatus 1 in the same way as the partition plate 61*a*. The partition plate 61*b* extends all over the region which is lower than the pair of backup rollers 43 and the recording medium in the up and down direction. Note that the partition plate 61*b* abuts the platen belt 41*b*. To describe it more concretely, the side wall at the upper stream side, in the conveying direction, of the partition plate 61*b* abuts a portion at the upper stream side of the platen roller 41*a* of the pair of backup rollers 43 via the platen belt 41*b*. In this way, the partition plate 61*b* is provided so as to spatially separate the region which is lower than the pair of backup rollers 43 in the conveying direction of the recording medium (the cross direction in FIG. 1).

In this way, the partition plates 61*a* and 61*b*, together with the pair of backup rollers 43, spatially separate the image recording region GR from the region which is at further upper stream from the pair of backup rollers 43 completely. In other words, the partition plates 61*a* and 61*b*, and the pair of backup rollers 43 are partitioning members which spatially partition the space at which the paper feeding unit 30 is provided and the image recording region GR at the inside of the image recording apparatus 1. Note that, in the present embodiment, the space which is further toward the paper feeding unit 30 side than the image recording region GR partitioned by the partition plates 61*a* and 61*b* is called a paper feeding region FR.

The suction fan with a filter 62 is a suction device for taking air outside the image recording apparatus 1 into the image recording apparatus 1. The suction fan with a filter 62 has a particulate dust collection filter 62*a*, and is configured so as to suck clean air into the image recording apparatus 1. Note that, because the inside of the image recording apparatus 1 is partitioned by the partition plates 61*a* and 61*b*, the suction fan with a filter 62 blows air into the image recording region GR.

The exhaust fan 63 is disposed at the image recording region GR side with respect to the partition plates 61*a* and 61*b* in the conveying direction, and is disposed at the portion lower than the conveyance unit 40 in the vertical direction (up and down direction). The exhaust fan 63 is exhausting means for exhausting air in the image recording region GR to the exterior of the image recording apparatus 1. Note that gas quantities of the suction fan with a filter 62, the exhaust fan 63, and the above-described platen suction fan 42*c* are set so as to have the relationship of the following formula.

Suction fan with a filter 62>exhaust fan 63>platen suction fan 42*c* (formula)

The exhaust fan 64 is exhausting means for ventilating the inside or the paper feeding FR. The exhaust fan 64 exhausts air inside the paper feeding FR to the exterior of the image recording apparatus 1.

The exhaust unit 70 is provided at the lower stream of the conveyance unit 40 in the conveying direction, and houses the recording medium after the completion of image recording. Note that, in the present embodiment, the exhaust unit 70 is disposed at the outside of the cover unit 20. However, the exhaust unit 70 can be disposed at the inside of the cover unit 20.

Hereinafter, operations of the image recording apparatus 1 having the above-described configuration will be described.

In the image recording apparatus 1, image recording operations which will be shown hereinafter are carried out at the time of recording an image upon the recording medium. In the image recording operations, first, the image recording apparatus 1 drives the pickup roller 32 to pick up the recording medium from the housing unit 31. The pickup roller 32 conveys the picked-up recording medium along an unillustrated path, and transmits it toward the pair of registration rollers 33.

Figure 3:
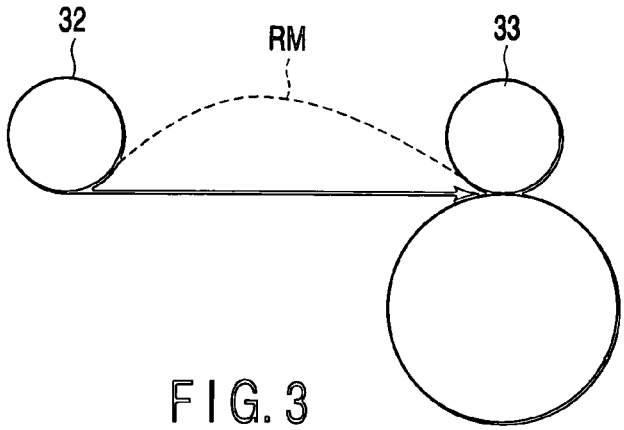
FIG. 3 is a schematic diagram showing a pickup roller and a pair of registration rollers.

When the tip of the recording medium in the conveying direction reaches the pair of registration rollers 33 in accordance with this conveyance, direction adjustment for the recording medium is carried out. The direction adjustment is carried out due to the pickup roller 32 and the pair of registration rollers 33 cooperating with one another. Hereinafter, the direction adjustment will be described in detail with reference to FIG. 3. FIG. 3 is a schematic side view showing the pickup roller 32 and the pair of registration rollers 33 at the time of direction adjustment.

The pickup roller 32 presses the tip of the recording medium in the conveying direction against the pair of registration rollers 33 by conveying the recording medium. Note that it is assumed that the recording medium is a rectangular cut sheet shape, and has the central axis in the direction of length. Further, it is assumed that the tip of the recording medium extends along the cross direction perpendicular to the direction of length. Note that there are cases in which, when the tip of the recording medium is pressed, the direction of the recording medium is not accurately adjusted. In other words, there are cases in which the tip of the recording medium comes in contact with the pair of registration rollers 33 in a state of being inclined.

The pickup roller 32 drives for a predetermined time after pressing the above-described recording medium. In accordance with this driving, the recording medium is conveyed further toward the pair of registration rollers 33. As a result, the recording medium RM rises up from the conveyance path, and curves in a loop shape as shown in FIG. 3. The curved recording medium RM in this way is pressed against the pair of registration rollers 33 such that the end portion thereof is made to be fitted into the pair of registration rollers 33 due to the conveying force from the pickup roller 32 and the self restoring force. Then, the tip of the recording medium RM comes in contact with all over the pair of registration rollers 33 in the direction of length. As a result, the cross direction of the recording medium is made to agree with the direction of length of the pair of registration rollers 33, and the central axis in the direction of length is made to agree with the conveying direction of the recording medium, and the adjustment is completed.

After the direction adjustment is completed, the pair of registration rollers 33 starts to drive, and conveys the recording medium toward the conveyance unit 40. Further, in accordance this conveyance, when the tip of the recording medium reaches the pair of backup rollers 43 in the conveying direction, direction adjustment for the recording medium as described above is carried out. Note that the platen suction unit 42 starts to drive in a timing before the recording medium reaches the pair of backup rollers 43. To described it concretely, the platen suction fan 42*c* starts to drive in the above-described timing. In accordance with this driving, negative pressure (suction force) is applied onto the platen belt 41*b* via the platen 42*b*.

Further, in the above-described timing, the platen roller 41*a* starts to drive. In the direction adjustment by the pair of registration rollers 33 and the pair of backup rollers 43, the pair of registration rollers 33 is driven for a predetermined time after the tip of the recording medium reached the pair of backup rollers 43. Note that the belt platen unit 41 has a conveying speed for a recording medium which is slower than that of the pair of registration rollers 33 as shown in the above-described configuration. Due to a difference between these conveying speeds and the conveyance for a predetermined time by the pair of registration rollers 33, the direction of the recording medium is adjusted by making the recording medium curve in a loop shape as described above, and the recording medium is precisely absorbed to the platen belt 41*b*.

After this adjustment is completed, the pair of registration rollers 33 is made to be freely rotate by disengaging the clutch after the recording medium is held such that a predetermined area thereof is absorbed to the platen belt 41*b*. In accordance therewith, the curved recording medium is released from the force applied from the rear end in the conveying direction (the side of the pair of registration rollers 33), and the pair of registration rollers 33 is made to be flat while being rotated by the self restoring force. Note that, because the recording medium is absorbed to and held at the platen belt 41*b* even when the posture is varied to be flat, the layout after the above-described direction adjustment with respect to the conveying direction is maintained. In this way, the direction adjustment between the pair of registration rollers 33 and the pair of backup rollers 43 is completed.

After the above-described direction adjustment was completed, the belt platen unit 41 conveys the recording medium toward the image recording region. When the recording medium reaches the position of the image recording unit 50 in the conveying direction, the recording heads 51 start image recording by ejecting inks. The respective recording heads 51 carry out recording of a desired image synchronously with the conveyance by the belt platen unit 41. The recording medium on which the image recording has been completed is exhausted to the exhaust unit 70.

In this way, the image recording apparatus 1 completes recording of an image with respect to a sheet of recording medium.

Note that, in the image recording operations, at the time of picking-up and direction adjustment for the recording medium, the recording medium receives friction and an impact from the pickup roller 32, the pair of registration rollers 33, and the pair of backup rollers 43 which are the conveying driving means.

Figure 4:
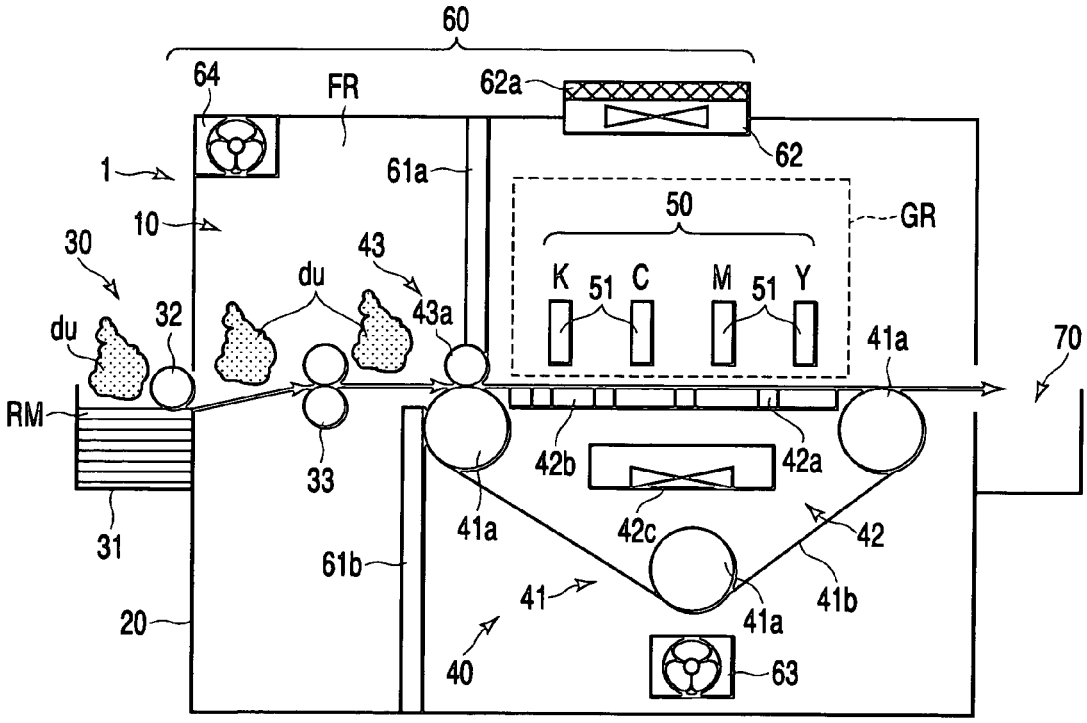
FIG. 4 is a schematic diagram showing the flow of particulate dust inside the image recording apparatus.

Therefore, there is the possibility that the recording medium may generate particulate dust such as paper particles, adhered dust, or the like (denoted by reference code du) as shown in FIG. 4. Moreover, at the time of the above-described direction adjustment, because the recording medium varies the posture thereof from a loop shape to a flat shape, there is the possibility that particulate dust may be further generated. Further, at the time of this direction adjustment, because the recording medium is nipped by the pair of registration rollers 33 and the pair of backup rollers 43 whose conveying speeds have a difference therebetween, there is the high possibility that particulate dust may be further generated by the difference between these speeds. Namely, the recording medium easily generate particulate dust at the paper feeding region FR.

Figure 5:
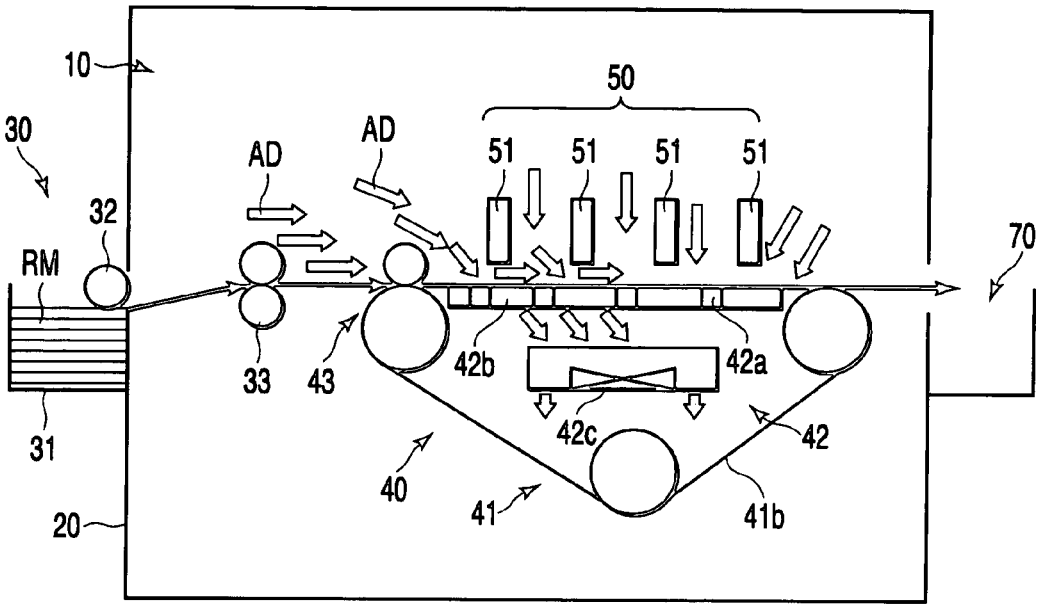
FIG. 5 is a schematic diagram showing the flow of air inside the image recording apparatus.

Here, in an image recording apparatus having a configuration in which there is no particulate dust preventing unit 60 as the conventional image recording apparatus, the flow of air generated in the image recording apparatus when the platen suction unit 42 drives will be described with reference to FIG. 5. Note that the outlined arrows AF shown in FIG. 5 typically show the flow of air.

Figure 6:
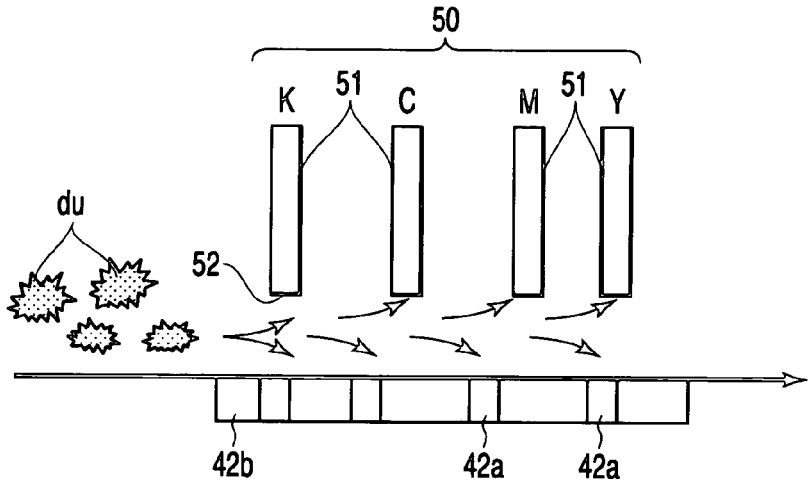
FIG. 6 is a schematic diagram showing the flow of particulate dust at the image recording region.
Figure 7:
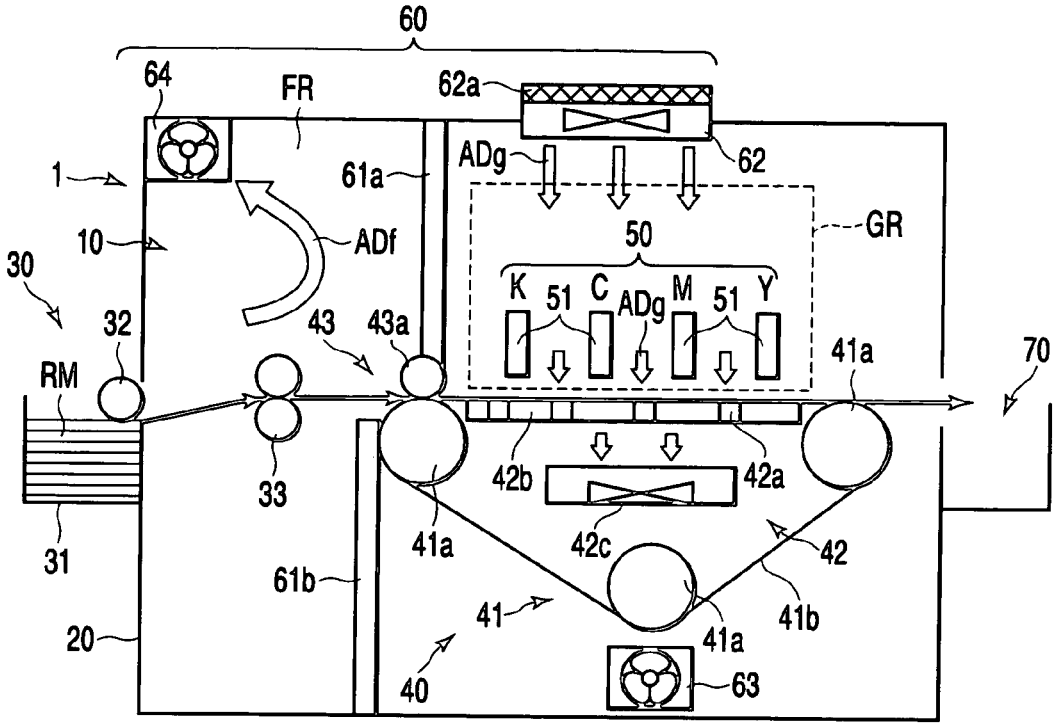
FIG. 7 is a schematic diagram showing the flow of air inside the image recording apparatus having a particulate dust preventing unit.

When the platen suction unit 42 drives, negative pressure is applied to a position facing the platen 42*b* at the belt platen unit 41. This position is the image recording region GR. Accordingly, the ambient air is concentrated on the image recording region due to this negative pressure. In such a flow of air, when particulate dust is generated at the paper feeding region FR as described above, the generated particulate dust is concentrated on the image recording region GR. The movement of particulate dust at the time of being concentrated will be described with reference to FIG. 6. FIG. 6 is an enlarged schematic side view showing the image recording unit 50 when particulate dust has concentrated. As shown in FIG. 6, some of the concentrated particulate dust are absorbed by the platen suction fan 42*c* via the holes 42*a*. However, some of the other concentrated particulate dust are adhered to the nozzles 52 of the recording heads 51, which have harmful influence on the ink jetting characteristic of the image recording unit 50.

The image recording apparatus 1 of the present embodiment has the particulate dust preventing unit 60 described with respect to the above-described configuration in order to reduce the influence of the particulate dust as described above. The particulate dust preventing unit 60 in the course of image recording will be described with reference to FIG. 7. The partition plates 61*a* and 61*b* of the particulate dust preventing unit 60 partition the inside of the image recording apparatus 1 completely into the image recording region GR and the paper feeding region FR. In accordance therewith, the suction force of the platen suction unit 42 does not substantially influence the paper feeding region FR.

In this way, the partition plates 61*a* and 61*b* prevent the particulate dust from intruding into the image recording region GR due to the air including particulate dust being sucked from the paper feeding region FR by the platen suction unit 42. Note that, because the partition plates 61*a* and 61*b* have partitioned as described above, the particulate dust is prevented from intruding even when the platen suction unit 42 does not drive.

Note that the partition plates 61*a* and 61*b* of the present embodiment abuts the pair of backup rollers 43 which is conveying driving means. Therefore, the partition plates 61*a* and 61*b* more exactly prevent particulate dust from intruding into the image recording region GR.

Note that, in the present embodiment, the partition plate 61*a* is provided at the lower stream of the pair of backup rollers 43. Therefore, the partition plate 61*a* prevent the intrusion of particulate dust from the paper feeding region FR at the lower stream of the pair of backup rollers 43 at which a variation in the posture of the recording medium is brought about. Accordingly, because the partition plate 61*a* prevent the intrusion of particulate dust at the lower stream in the conveying direction of the recording medium at the region at which there is a high rate of occurrence of particulate dust, the particulate dust is more effectively prevented from intruding.

Note that the pair of backup rollers 43 is conveying driving means which is closest to the image recording region. Accordingly, there is the high possibility that the pair of backup rollers 43 may generate particulate dust by an impact and friction even when direction adjustment is not carried out. Accordingly, even when the pair of backup rollers 43 does not carry out direction adjustment, the partition plate 61*a* prevent particulate dust from intruding into the image recording region GR by being disposed near the pair of backup rollers 43. In this way, the partition plate 61*a* of the present embodiment is preferably disposed near the conveying driving means which is closest to the image recording region. Note that, as in the present embodiment, the partition plate 61*a* is more preferably disposed at the lower stream of the pair of backup rollers 43 which can be a source of generating particulate dust.

Further, the pair of backup rollers 43 cooperates with the partition plates 61*a* and 61*b* to partition the inside of the image recording apparatus 1 completely into the image recording region GR and the paper feeding region FR. Because the pair of backup rollers 43 abuts the recording medium in the course of conveying the recording medium, particulate dust is prevented from intruding from the paper feeding region FR. In this way, because the conveying means is used for partitioning the space, the image recording apparatus 1 of the present embodiment prevents particulate dust from intruding into the image recording region without deteriorating the conveying ability for the recording medium.

Note that, the partition plate 61*a* of the present embodiment is disposed at a position overlapped with the pair of backup rollers 43 in the conveying direction. To describe it concretely, the partition plate 61*a* is disposed at a position at which at least a part thereof is overlapped with the backup roller 43*a* in the conveying direction. Note that, because the pair of backup rollers 43 pressure-contacts the recording medium, there is no gap with the recording medium. Further, the pair of backup rollers 43 has a rigid body and a high accuracy as compared with the recording medium. Therefore, as compared with the case in which the partition plate 61*a* is largely displaced from the pair of backup rollers 43, the partition plate 61*a* more exactly partitions the space into the image recording region GR and the paper feeding region FR by the pair of backup rollers 43.

Further, when the partition plate 61*a* is disposed at the position overlapped with the backup roller 43*a* described above, because the backup roller 43*a* is provided between the partition plate 61*a* and the recording medium, the partition plate 61*a* is positioned at a position spaced from the recording medium. Therefore, even when the recording medium in the course of conveying rises up from the conveyance path by being bent or the like, there is no case in which the partition plate 61*a* abuts the recording medium. Accordingly, the partition plate 61*a* having the above-described configuration is prevented from generating jamming.

Further, even when paper particles or dust which have been adhered onto the recording medium at the time of conveying the recording medium again are remained on the recording medium RM, the pair of backup rollers 43 can fix those onto the recording medium or the pair of backup rollers 43 itself by pressing those. In this way, the pair of backup rollers 43 as well prevents particulate dust from intruding from the paper feeding region FR.

Further, the exhaust fan 64 is provided at the paper feeding region FR. In accordance therewith, the exhaust fan 64 exhausts foul air including particulate dust greatly in the paper feeding region FR, and cleans the air in the paper feeding region FR, and prevent the image recording region GR from being contaminated even when the air in the paper feeding region FR has entered the inside of the image recording region GR. Moreover, because the exhaust fan 64 exhausts the air in the paper feeding region FR to the exterior, the exhaust fan 64 brings about the flow of air ADf shown by the outlined arrow in FIG. 7 in the paper feeding region FR. The flow of air ADf is a flow of air going toward the exterior of the image recording apparatus 1. The exhaust fan 64 more exactly prevents the air including particulate dust from intruding into the image recording region GR by the flow of air ADf.

Further, in the particulate dust preventing unit 60, the gas quantities of the suction fan with a filter 62, the exhaust fan 63, and the platen suction fan 42*c* described above have the relationship as the formula shown in the above-described configuration. In this way, because the suction fan with a filter 62 has a gas quantity larger than those of the other fans, the suction fan with a filter 62 makes the image recording region GR be at positive pressure. In accordance therewith, air in the atmosphere including particulate dust is prevented from intruding into the image recording region GR from the gap of the cover unit 20.

Further, the suction fan with a filter 62 having a large gas quantity is disposed above the exhaust fan 63 and the platen suction fan 42*c* described above with the platen 42*b* therebetween. Therefore, these fans bring about the flow of air toward the down direction in the image recording region GR. The suction fan with a filter 62 makes only clean air flow into the image recording region GR via the filter 62*a*. Therefore, even when the conveyance unit 40 and the recording medium generate particulate dust due to frictions and an impact, the particulate dust is prevented from moving toward the image recording unit 50 due to the flow of air, and the particulate dust is prevented from adhering to the image recording unit 50.

Further, the exhaust fan 63 has a gas quantity greater than that of the platen suction fan 42*c*. In addition thereto, the exhaust fan 63 is disposed at the exhausting side of the platen suction fan 42*c* (at the lower portion of the image recording apparatus 1). According to the configuration, the exhaust fan 63 more exactly exhausts the air transmitted by the platen suction fan 42*c* to the exterior of the image recording apparatus 1. In this configuration as well, the image recording apparatus 1 prevents the particulate dust from moving toward the image recording unit 50, and prevents the particulate dust from adhering to the image recording unit 50.

In this way, the image recording apparatus 1 of the present embodiment reduces particulate dust intruding into the image recording region GR by the particulate dust preventing unit 60, and can prevent non-ejection, ejection curve, or the like of the image recording unit 50, and achieves image recording in a high image quality and with high reliability.

Note that the particulate dust preventing unit 60 of the present embodiment has the partition plates 61*a* and 61*b*. However, the particulate dust preventing unit 60 can be configured by only the partition plate 61*a*. In this case as well, the particulate dust preventing unit 60 can reduce particulate dust intruding into the image recording region GR as compared with the case in which there is no partition plate 61*a*.

Figure 8:
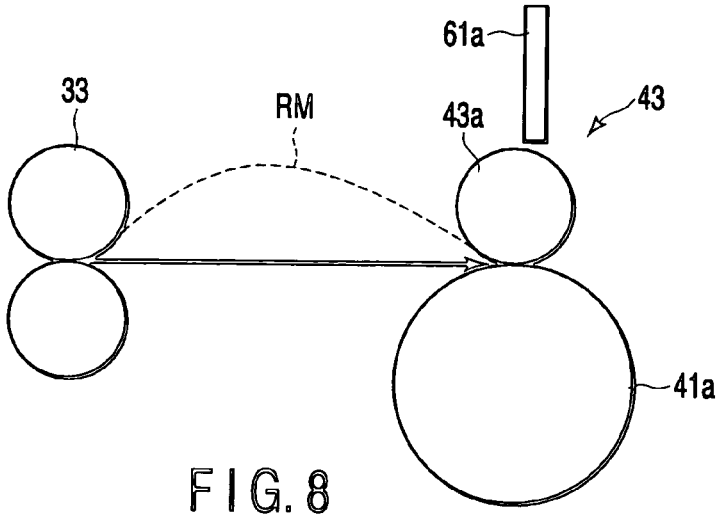
FIG. 8 is a schematic side view showing a modified example of a partition plate.

Further, the partition plate 61*a* of the present embodiment abuts the backup roller 43*a*. However, as shown in FIG. 8, the partition plate 61*a* can be disposed so as to be spaced from the backup roller 43*a*. Note that there is the effect of preventing the intrusion of particulate dust when the spaced distance is less than or equal to about 10 mm. However, the spaced distance is preferably less than or equal to 2 mm. Note that, when the spaced distance is set to be greater than or equal to about 0.3 mm and less than or equal to about 0.1 mm, while interference between the partition plate 61*a* and the backup roller 43*a* due to the respective parts and the tolerance of assembling those is being prevented, the effect in which particulate dust is prevented from intruding can be more effectively obtained as compared with the case in which the spaced distance is about 10 mm. Note that the partition plate 61*b* can be disposed so as to be spaced from the platen belt 61*b* in the same way as the partition plate 61*a* described above.

Moreover, when the partition plate 61*a* is assembled into the image recording apparatus 1, provided that the partition plate 61*a* is fixed by inserting a thickness gage between the backup roller 43*a* and the cover unit 20, or the like, the distance can be made little which is, for example, 0.1 mm, and moreover, the effect of the partition plate 61*a* can be improved. Note that, due to the partition plate 61*a* being spaced even slightly, there is no case in which particulate dust adhered to the surface of the backup roller 43*a* accumulates between the partition plate 61*a*. Accordingly, due to the partition plate 61*a* being spaced from the backup roller 43*a*, it is possible to avoid a risk that accumulated material drops down on the recording medium, and particulate dust is more effectively prevented from being generated.

Figure 9:
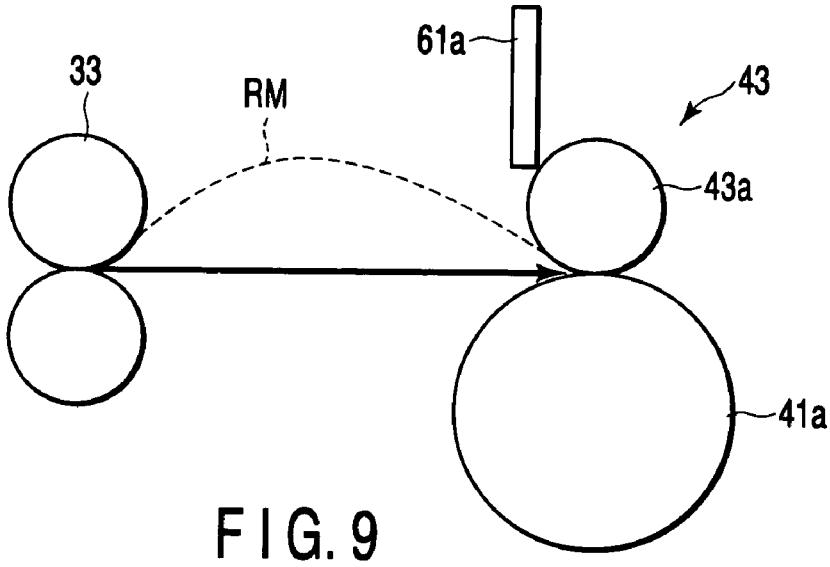
FIG. 9 is a schematic side view showing a partition plate in an image recording apparatus according to a second embodiment of the invention.

Next, the image recording apparatus 1 according to a second embodiment of the present invention will be described with reference to FIG. 9. Note that, in the present embodiment, structural portions which are the same as those in the first embodiment are denoted by the same reference numerals, and descriptions thereof will be omitted.

In the image recording apparatus 1 of the present embodiment, the layout of the partition plate 61*a* is different from that of the image recording apparatus 1 of the first embodiment. The partition plate 61*a* of the present embodiment is, as shown in FIG. 9, disposed so as to touch a portion at the upper stream of the backup roller 43*a* in the conveying direction. In accordance therewith, the partition plate 61*a* reduces particulate dust intruding into the image recording region GR from the paper feeding region FR in the same way as in the first embodiment.

Note that, because the backup roller 43*a* and the partition plate 61*a* touch one another, the partition plate 61*a* scratches particulate dust adhered to the backup roller 43*a* off. The scratched-off particulate dust accumulates between the backup roller 43*a* and the partition plate 61*a*, and a little quantity thereof does not drop down on the recording medium. However, when an amount of accumulated particulate dust is increased, and a large quantity of particulate dust is accumulated, there are cases in which the particulate dust drops down.

Note that, in the image recording apparatus 1 of the present embodiment, the partition plate 61*a* is disposed at the upper stream of the backup roller 43*a* in the conveying direction. Therefore, even when the above-described accumulated particulate dust drops down on the recording medium, the positions where most of the particulate dust drop down can be set at the upper stream of the pair of backup rollers 43.

As a result, the pair of backup rollers 43 can adhere the dropped particulate dust to the backup roller 43*a* again or can fix the dropped particulate dust onto the recording medium by pressing the dropped particulate dust. In this way, the image recording apparatus 1 of the present embodiment reduces that the particulate dust accumulated between the backup roller 43*a* and the partition plate 61*a* floats in the atmosphere again.

Figure 10:
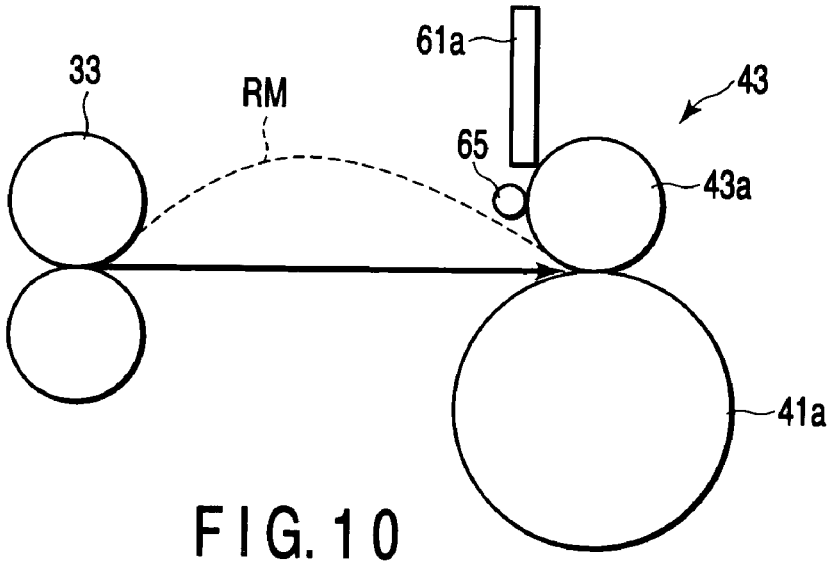
FIG. 10 is a schematic side view showing a partition plate in an image recording apparatus according to a third embodiment of the invention.

Next, the image recording apparatus 1 according to a third embodiment of the present invention will be described with reference to FIG. 10. Note that, in the present embodiment, configurations which are the same as those in the second embodiment are denoted by the same reference numerals, and descriptions thereof will be omitted.

The image recording apparatus 1 of the present embodiment further has a cleaner mechanism 65 in addition to the configuration of the second embodiment. The cleaner mechanism 65 is cleaning means for cleaning particulate dust. In the present embodiment, the cleaner mechanism 65 is configured in a pat shape, and accepts particulate dust and collects the accepted particulate dust. As shown in FIG. 10, the cleaner mechanism 65 is disposed at the upper stream in the conveying direction and at the lower stream in the up and down direction with respect to the partition plate 61*a*. In other words, the cleaner mechanism 65 is disposed at the same side as the partition plate 61*a* with respect to the backup roller 43*a*, and is disposed below the partition plate 61*a*.

Therefore, when the aforementioned accumulated particulate dust drops down at the recording medium side, the cleaner mechanism 65 accepts the dropped particulate dust. In accordance therewith, the possibility that the particulate dust drops down upon the recording medium is reduced, and the air in the image recording apparatus 1 is further prevented from being contaminated by the particulate dust.

Figure 11:
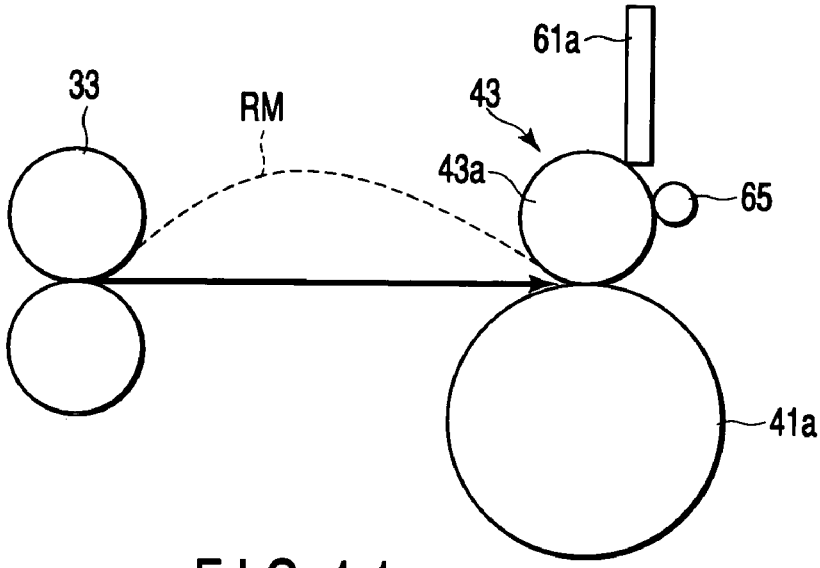
FIG. 11 is a schematic side view showing a modified example of the partition plate of the third embodiment.

Note that the cleaner mechanism 65 can be applied to a configuration in which the partition plate 61*a* is disposed at the lower stream of the backup roller 43*a* as shown in FIG. 11. In this case, the cleaner mechanism 65 is disposed at the lower stream side in the conveying direction and at the lower side in the up and down direction with respect to the partition plate 61*a*. In accordance with this layout, the cleaner mechanism 65 achieves the effect of preventing contamination in the image recording apparatus having the configuration in which the partition plate 61*a* is disposed at the lower stream side of the backup roller 43*a*.

Note that, provided that the cleaner mechanism 65 can collect dropping particulate dust, and can suppress that the collected particulate dust floats in the atmosphere again, the cleaner mechanism 65 can be made to have a configuration other than a pat type.

Figure 12:
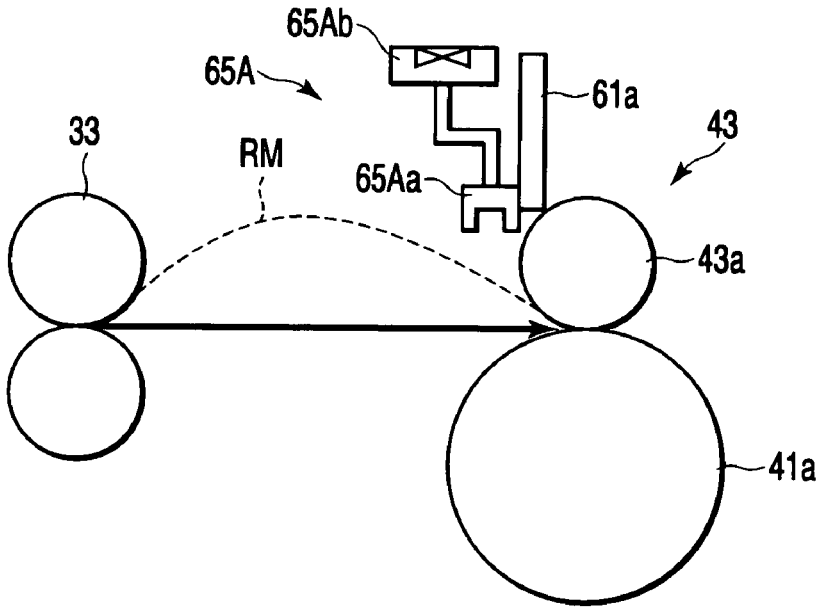
FIG. 12 is a schematic side view showing a cleaner mechanism in an image recording apparatus according to a fourth embodiment of the invention.

Hereinafter, the image recording apparatus 1 according to a fourth embodiment of the present invention will be described with reference to FIG. 12. Note that, in the present embodiment, configurations which are the same as those in the third embodiment are denoted by the same reference numerals, and descriptions thereof will be omitted.

In the image recording apparatus 1 of the present embodiment, a configuration of a cleaner mechanism 65A is different from that of the cleaner mechanism 65 of the third embodiment. The cleaner mechanism 65A of the present embodiment is a suction device as shown in FIG. 12. The cleaner mechanism 65A has a suction nozzle 65Aa and a cleaner suction fan 65Ab providing suction force to the suction nozzle 65Aa, and exhausts air sucked by the suction nozzle 65Aa to the exterior of the image recording apparatus 1. The suction nozzle 65Aa is disposed at the upper stream side in the conveying direction and at the lower side in the up and down direction with respect to the partition plate 61*a*. In accordance therewith, the cleaner mechanism 65A of the present embodiment reduces the possibility that the particulate dust drops down upon the recording medium in the same way as in the third embodiment by sucking the dropping particulate dust, and prevents the air in the image recording apparatus 1 from being contaminated by the particulate.

Note that, because the cleaner mechanism 65A sucks ambient air of the suction nozzle 65Aa, the particulate dust on the recording medium and the particulate dust floating in the vicinity of the pair of backup rollers 43 can be sucked and removed at the upper stream of the pair of backup rollers 43. Accordingly, the image recording apparatus 1 of the present embodiment further prevents the air in the image recording apparatus 1 from being contaminated by particulate dust.

Note that the cleaner mechanism 65A can be configured so as to further prevent contamination by particulate dust by being used together with the cleaner mechanism 65.

Next, the image recording apparatus 1 according to a fifth embodiment of the present invention will be described with reference to FIG. 13. Note that, in the present embodiment, configurations which are the same as those in the first embodiment are denoted by the same reference numerals, and descriptions thereof will be omitted.

Figure 13:
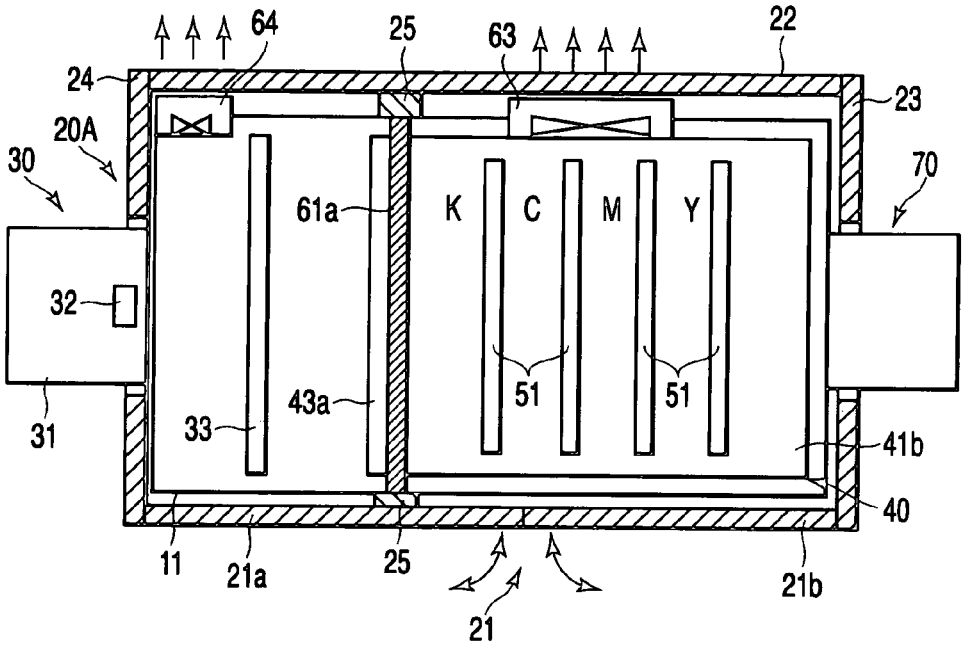
FIG. 13 is a schematic sectional view showing an image recording apparatus according to a fifth embodiment of the invention.
Figure 14:
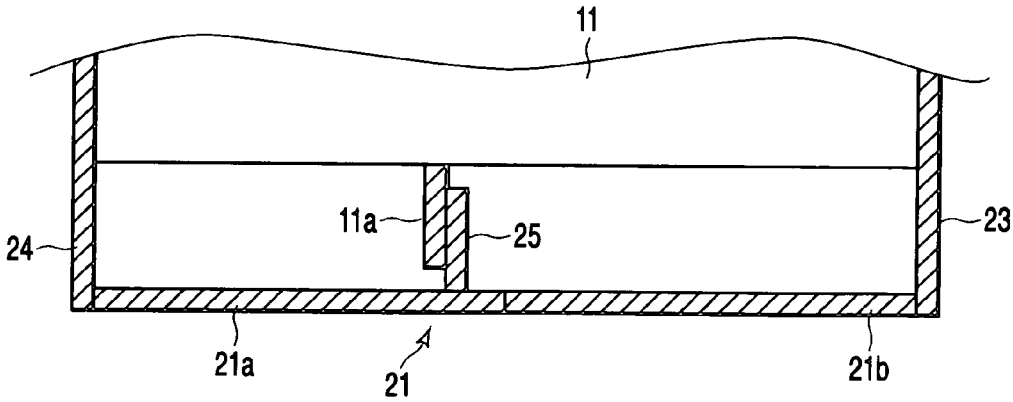
FIG. 14 is a schematic sectional view showing a modified example of a rib of the fifth embodiment.

In the image recording apparatus 1 of the present embodiment, a configuration of a cover unit 20A is different from the cover unit 20 of the first embodiment as shown in FIG. 13. Note that the cover unit 20A will be described in detail with reference to FIG. 13.

The cover unit 20A of the present embodiment has a top cover (not illustrated) and side walls, and is covered on the main body 10 from the top portion, and covers the entire main body 10. The side walls of the cover unit 20A are configured by a cover front portion 21 and a cover rear portion 22 which face in the cross direction of the image recording apparatus 1, and cover side portions 23 and 24 which face one another in the conveying direction.

The cover front portion 21 has a left cover 21*a* and a right cover 21*b*, and those are respectively supported so as to be pivotable by the cover side portions 23 and 24, and configure a window portion which can be opened and closed. The image recording apparatus 1 of the present embodiment is configured so as to be able to easily access to the inside of the apparatus at the time of jamming processing or the like through the aforementioned window portion.

The both ends of the cover rear portion 22 are fixed by the cover side portions 23 and 24. Further, at the cover rear portion 22, slits for exhausting are provided at positions corresponding to the exhaust fans 63 and 64. The cover side portion 23 is a side wall at the exhaust unit 70 side, and an opening for ejecting a recording medium is provided such that a recording medium ejected from the conveyance unit 40 is ejected. The cover side portion 24 is a side wall at the paper feeding unit 30 side, and an opening for feeding a recording medium is provided such that a recording medium picked up from the housing unit 31 can be conveyed to the pair of registration rollers 33.

Further, the partition plates 61*a* and 61*b* of the present embodiment are fixed to the frame 11 of the main body 10, and have width sizes which are substantially the same as that of the main body 10. Further, the partition plates 61*a* and 61*b* are disposed all over the entire main body 10 in the up and down direction together with the pair of backup rollers 43, and partition the inside of the main body 10 completely into the paper feeding region FR and the image recording region GR with the pair of backup rollers 43 being as the boundary.

In this way, in the case of the configuration in which the cover unit 20 is made to cover the main body 10, depending on an assembling accuracy, there are cases in which gaps are generated between the cover unit 20 and the main body 10. Therefore, the cover unit 20 of the present embodiment has ribs 25 which are members for sealing the gaps. The ribs 25 are disposed all over the inner periphery of the cover unit 20 at the partition plates 61*a* and 61*b*, and positions corresponding to the partition plates 61*a* and 61*b*, and fill up the gaps between the cover unit 20 and the main body 10. To describe it concretely, the ribs 25 are attached to the cover front portion 21, the cover rear portion 22, and the aforementioned top cover, and are configured so as to touch the partition plates 61*a* and 61*b*. In particular, the ribs 25 of the cover front portion 21 are configured so as to touch the partition plates 61*a* and 61*b* at the time of closing the window portion.

According to the above-described configuration, the image recording apparatus 1 of the present embodiment gets rid of gaps between the main body 10 and the cover unit 20, and more exactly prevents particulate dust from intruding into the image recording region GR from the paper feeding region FR.

Note that, in the present embodiment, the ribs 25 cooperates with the partition plates 61*a* and 61*b* to partition the inside of the image recording apparatus 1. However, it is possible that the ribs 25 cooperates with the partition plates 61*a* and 61*b*, and the frame 11 holding the partition plates 61*a* and 61*b* to partition it. To describe it concretely, the ribs 25 are made to touch the frame 11 holding the partition plates 61*a* and 61*b*, and can partition the space in the image recording apparatus 1 by the partition plates 61*a* and 61*b*, and the frame 11.

Further, in the present embodiment, the partition plates 61*a* and 61*b* are used for partitioning the space in the image recording apparatus 1. However, the frame 11 can be configured so as to partition the space in the image recording apparatus 1 in place of the partition plates 61*a* and 61*b*. Namely, the frame 11 can be formed so as to be integrated with the partition plates 61*a* and 61*b*. In such a case, provided that the frame 11 can partition the space in the image recording apparatus 1, it goes without saying that the frame 11 can be made to be a configuration other than a tabular shape.

Further, ribs 11*a* for being touched with the ribs 25 can be provided at the frame 11. The rib 11*a* extends along the cross direction so as to be overlapped with the rib 25 in the cross direction of the image recording apparatus 1. According to this configuration, the rib 11*a* and the rib 25 provide a high-resistance with respect to the air made to flow from the paper feeding region FR to the image recording region GR, and more exactly prevent the image recording region GR from being contaminated. Note that the rib 25, in place of the rib 11*a*, can obtain the effect which is the same as described above by being configured so as to be overlapped with the partition plates 61*a* and 61*b* in the cross direction. Further, the rib 25 and the rib 11*a* extend along the cross direction. However, provided that at least some portions of the rib 25 and the rib 11*a* can be overlapped in the cross direction, there is no case in which the rib 25 and the rib 11*a* are limited to the extending direction. Note that the rib 25 and the rib 11*a* are preferably disposed so as to touch each other.

Figure 15:
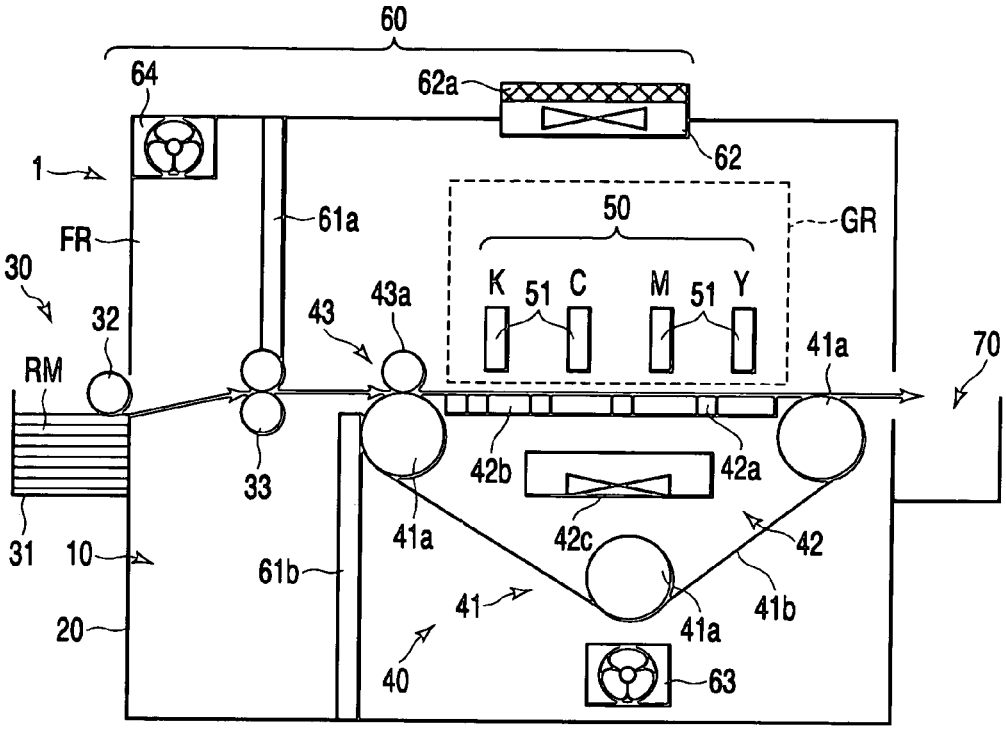
FIG. 15 is a schematic side view showing an image recording apparatus according to a sixth embodiment of the invention.

Next, the image recording apparatus 1 according to a sixth embodiment of the present invention will be described with reference to FIG. 15. Note that, in the present embodiment, configurations which are the same as those in the first embodiment are denoted by the same reference numerals, and descriptions thereof will be omitted.

In the image recording apparatus 1 of the present embodiment, the layout of the partition plate 61*a* is different from that of the image recording apparatus 1 of the first embodiment. To describe it concretely, the partition plate 61*a* of the present embodiment is disposed at the lower stream side of the pair of registration rollers 33. The bottom end of the partition plate 61*a* abuts the pair of registration rollers 33. In such a configuration as well, the image recording apparatus 1 can reduce the intrusion of particulate dust into the image recording region GR as compared with the case in which the partition plate 61*a* is not provided. Note that the partition plates 61*a* can be provided at positions respectively corresponding to the pickup roller 32, the pair of registration rollers 33, and the pair of backup rollers 43.

Figure 16:
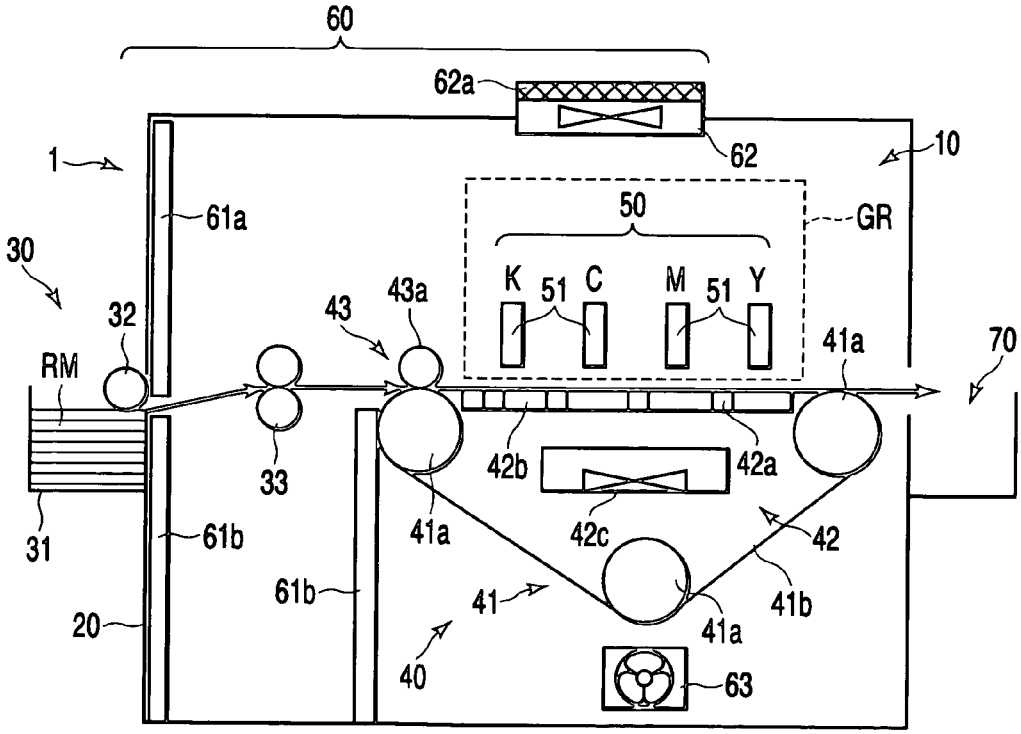
FIG. 16 is a schematic side view showing a modified example of the image recording apparatus according to the sixth embodiment.

Further, the partition plates 61*a* and 61*b* can be provided at the lower stream of the pickup roller 32 as shown in FIG. 16. According to such a configuration, the partition plates 61*a* and 61*b* prevent particulate dust from intruding from the exterior of the image recording apparatus 1. Accordingly, in this configuration as well, the partition plates 61*a* and 61*b* can reduce particulate dust intruding into the image recording region GR. In this way, the partition plates 61*a* and 61*b* can reduce particulate dust intruding into the image recording region GR in the case in which the partition plates 61*a* and 61*b* are disposed at positions other than the positions corresponding to the rollers as shown in FIG. 16. For example, the partition plates 61*a* and 61*b* can be disposed so as to be close to or to touch the recording medium, and can be configured so as to prevent particulate dust from intruding into the image recording region GR. Note that, when the partition plates 61*a* and 61*b* are made to touch the recording medium, in order to prevent an increase of loads on the conveyance of the recording medium and damage to the recording medium, the partition plates 61*a* and 61*b* are preferably materials, such as a polyester film, a Teflon sheet, or the like, which are flexible and whose coefficients of friction are little. Further, in the image recording apparatus 1 in FIG. 16, two of the partition plates 61*b* are provided. In this way, the image recording apparatus 1 reduce particulate dust intruding into the image recording region GR by providing a plurality of the partition plates 61*a* and/or the partition plates 61*b*.

In the present embodiment which has been described above, it has been described by using the heads of four colors of KCMY. However, in an image recording apparatus of a one color type, the same effect can be obtained due to the present embodiment being applied thereto.

Further, it has been described by using the type of four serial heads of KCMY. However, in an image recording apparatus in which one serial head is configured by a plurality of heads, the same effect can be obtained due to the present embodiment being applied thereto.

The serial head type (fixed head) image recording apparatus has been described above. However, in a multi-scan head type (movable head) image recording apparatus as well, the same effect can be obtained due to the present embodiment being applied thereto. Further, the cut paper type image recording apparatus has been described above. However, for example, in an image recording apparatus of serial paper type, such as a roll paper, due to the present embodiment being applied thereto, the same effect can be obtained.

Figure 17:
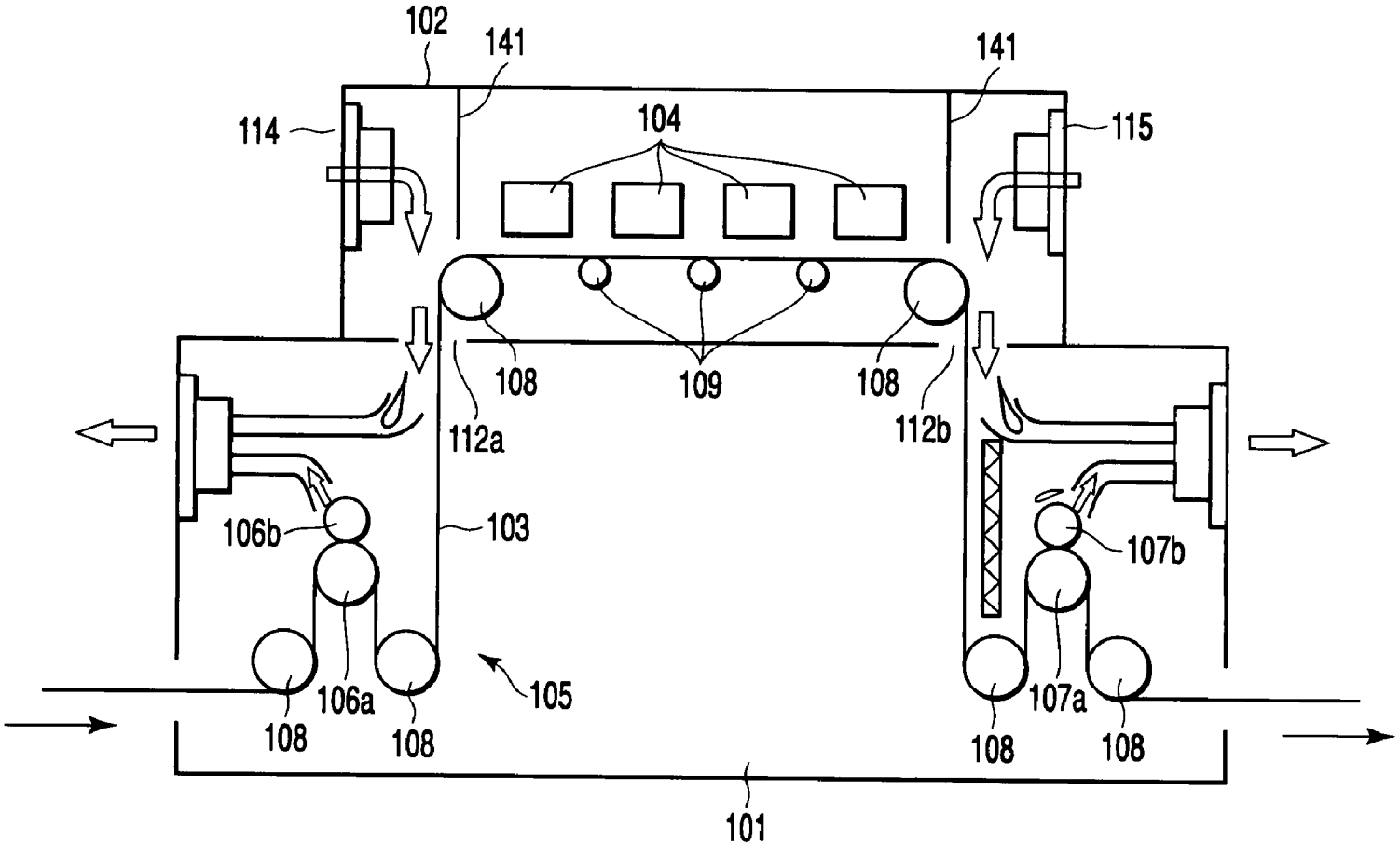
FIG. 17 (PRIOR ART)
FIG. 17 is a schematic side view showing a conventional image recording apparatus.

Note that the image recording apparatus of a type using a roll paper nips a recording medium by a pair of conveyance rollers at the respective upper stream and lower stream so as to stride over the image recording region in the conveying direction of the recording medium, in the same way as in the conventional image recording apparatus shown in FIG. 17. Then, at the time of conveying the recording medium, the pair of conveyance rollers at the lower stream side draws the recording medium with conveying force greater than that of the pair of conveyance rollers at the upper stream side such that a predetermined tension affects on the recording medium. In this way, at the recording medium in the course of being conveyed, the portion at the lower stream draws the portion at the upper stream, which assists the conveyance of the recording medium itself. Accordingly, it can be thought that the serial recording medium is used as one part of the recording medium driving means.

Accordingly, in the image recording apparatus of the type of using a roll paper, it is effective that the partition plate which is a partitioning member is disposed so as to touch or close to a roller such as a conveyance roller from the standpoint of partitioning the inside of the image recording apparatus, and it is effective that the partition plate is disposed so as to touch or close to the recording medium.

According to the above descriptions, the present invention can provide an image recording apparatus which can carry out image recording in high image quality and with high reliability, without deteriorating the conveying ability for a recording medium.

What is claimed is:

1. An image recording unit which records an image by ejecting ink drops to a recording medium; a conveyance unit which conveys the recording medium in a conveying direction at a time of image recording; a recording medium feeding unit which feeds the recording medium to the conveyance unit, the recording medium feeding unit being located on an upstream side of the image recording unit in the conveying direction; and a particulate dust preventing unit which includes a partitioning structure that partitions space in the image recording apparatus into an image recording region in which image recording is carried out by the image recording unit, and a paper feeding region in which the recording medium is fed by the recording medium feeding unit such that the partitioning structure prevents particulate dust from entering the image recording region from the paper feeding region; wherein the partitioning structure comprises a partition plate, and the partition plate overlaps a member of the conveyance unit that provides driving force to the recording medium at one of an upstream side and a downstream side of the member, which respect to a center of the member, in a conveying direction of the recording medium by the conveyance unit; and wherein the partitioning structure is located on the upstream side of the image recording unit in the conveying direction wherein the partition plate is spaced apart from the member of the conveyance unit by a predetermined interval.

2. An image recording apparatus according to claim 1, wherein the conveyance unit includes conveying driving means for providing driving force to the recording medium, and the conveyance unit conveys the recording medium at a time of image recording by the conveying driving means;

wherein the conveying driving means comprises said member of the conveyance unit that provides driving force to the recording medium; and wherein the particulate dust preventing unit which comprises: (i) suction means, which is disposed at an upper portion of the image recording apparatus, for sucking air into an image recording region via a dust collection filter, and (ii) exhausting means, which is disposed at a portion of the image recording apparatus lower than the conveying driving means, for exhausting air from the image recording apparatus.

3. An image recording apparatus according to claim 2, wherein an air suction quantity of the suction means is set to be greater than a displacement of the exhausting means.

4. An image recording apparatus according to claim 2, wherein the particulate dust preventing unit further comprises additional exhausting means for exhausting air in a paper feeding region to outside of the image recording apparatus.

* * * * *